US006648727B1

(12) United States Patent
Aldridge, Jr.

(10) Patent No.: US 6,648,727 B1
(45) Date of Patent: Nov. 18, 2003

(54) CNC DUAL WORKHEAD CHUCKER GRINDER

(76) Inventor: R. Warren Aldridge, Jr., 10022 Nadina Dr., Huntsville, AL (US) 35803

( * ) Notice: Subject to any disclaimer, the term of this patent is extended or adjusted under 35 U.S.C. 154(b) by 68 days.

(21) Appl. No.: 09/662,093

(22) Filed: Sep. 14, 2000

(65) Prior Publication Data

(65)

Related U.S. Application Data

(60) Provisional application No. 60/153,777, filed on Sep. 14, 1999.

(51) Int. Cl.[7] ..... B24B 49/00

(52) U.S. Cl. ..... 451/5; 451/8; 451/246; 451/398

(58) Field of Search ..... 451/49, 5, 8, 11, 451/246, 397, 398, 402

(56) References Cited

U.S. PATENT DOCUMENTS 3,498,006 A * 3/1970 Lang et al. ..... 451/246
4,144,676 A * 3/1979 Moll ..... 451/246
5,779,518 A * 7/1998 Schmitz ..... 451/28
6,039,634 A * 3/2000 Bach et al. ..... 451/49
6,190,242 B1 * 2/2001 Herrscher et al. ..... 451/177
6,200,200 B1 * 3/2001 Himmelsbach ..... 451/62
6,390,907 B1 * 5/2002 Metzler et al. ..... 451/360
6,431,954 B1 * 8/2002 Junker ..... 451/11

* cited by examiner

*Primary Examiner*—M. Rachuba
(74) *Attorney, Agent, or Firm*—Joseph H. Beumer

(57) ABSTRACT

A grinding machine has an abrasive wheel mounted on a spindle carried by a wheelhead which provides for movement in a direction perpendicular to the spindle. A pair of workheads are separately mounted on workslides and cross slides so that the workheads may be moved along an X-axis or a Y-axis as required to bring chucks of the workheads into grinding position. Sliding movement of the workslides and cross slides is produced by ball screws powered by servo motors and mounted on bearing housings, with the ball screws propelling ball nuts connected to the slides. The machine uses CNC computerized controls, with each of the workheads having a separate and independent control. This enables attainment of a high degree of precision.

15 Claims, 7 Drawing Sheets

CNC DUAL WORKHEAD CHUCKER GRINDER

CROSS REFERENCE TO RELATED APPLICATION

This application claims the benefit of applicant's Provisional Application Serial No. 60/153,777, filed Sep. 14, 1999.

FIELD OF THE INVENTION

This invention relates to grinding machines and more particularly to high-precision grinders using CNC controls.

BACKGROUND OF THE INVENTION

Definitions: "CNC" refers to computer numerical control systems as employed for operation of machine tools.

"Chucker" refers to a workhead for a grinding or turning machine having a clamping device or chuck capable of holding only a part short enough not to require a tailstock at the opposite end of the part during grinding or turning. No part support other than the chuck is provided at the driven end of the part.

Grinding machines using a single workhead and a CNC control system have been employed previously for high-precision applications. Prior grinders of this type have generally coupled a CNC control system to a grinding wheel spindle for movement along an in-feed axis, which brings the wheel into contact with a supported workpiece being held in position on a single workhead by a chuck or other clamping device. The workhead in this approach is not fed into the wheel for grinding, but is held in place once adjusted.

It would be advantageous to provide improved CNC chucker grinders capable of providing increased production rates without sacrificing any of the high degree of precision obtained.

SUMMARY OF THE INVENTION

The present invention is directed to a grinding machine comprising a grinding wheel and a pair of workheads mounted on supporting structure enabling independent movement of the workheads toward and away from the grinding wheel, with operation of the workheads and chucks attached thereto being carried out under separate and independent CNC controls.

Supporting structure for the workheads includes a horizontally extending base having a generally flat bed surface carrying laterally extending linear rails or V and flat linear motion guides adapted for receiving mating elements placed underneath a pair of aligned workslides. Movement of the workslides in a lateral direction, generally parallel to the grinding wheel spindle, may be carried out by linear ball screws driven by servo motors. The ball screws typically are rotatably mounted in bearing blocks or housing and are connected to ball nuts which are fixedly attached to the workslides.

Each of the workslides carries a cross slide and connecting elements necessary for support and movement of an upper platform of the cross slide in a direction perpendicular to the wheel spindle. The platform rests on a lower block portion of the workslide, with linear rails attached to the lower portion and mating elements provided underneath the upper platform. Movement of the cross slide is enabled by use of a ball screw, bearing blocks or housings and a driving servo motor in a manner. similar to those used for work slide movement.

A spindle case aligned for driving a workhead chuck is provided of the upper platform of each cross slide. A spindle carried in the case extends from the innermost side of the. case and has a spindle nose which serves as a plate for attachment of a rotatable chuck. The chuck is driven by a servo motor placed alongside and propelling a belt engaged with pulleys on the motor and spindle.

The machine may thus provide for controlled linear movement of both workheads and a wheelhead along five or more linear axes and for controlled rotary movement of each of two chucks around rotary axes. Each of the movements involved is controlled by the CNC System of the machine. In order to obtain high precision between workpieces being simultaneously ground-while supported on dual workheads, each of the workheads is controlled independent. of the other, but in coordination with control of the grinding wheel.

The CNC control system may make use of computer software programmed to include parameters such as extent and timing of movements, grinding speeds, starting and final dimensions of workpieces and the like. Additional data entries and modifications may be inserted by a keyboard operater using conventional techniques. Information derived from in-process gauges may also be fed into the control system to provide precision timing of grinding shutoffs. By using independent CNC controls for the two workheads, separate workpieces may be ground to meet the same or different requirements. Grinding of one workpiece may be completed and terminated by retracting its workhead while the other is still being ground.

Grinding machines of this invention provide a high degree of precision such as 20 millionths of an inch. This result is enabled by various factors, including use of servo motors having a resolver or encoder capable of providing a high number of incremental counts per revolution such as 4,000,000. This level of precision would not be available if a single CNC control were used in propelling a grinding wheel against a pair of separately supported workpieces.

An increased production rate, twice the rate for single workhead machines once set-up is performed, may be obtained by this invention without any compromise of precision.

It is, therefore, an object of this invention to provide a high-precision grinding machine capable of operating at an increased production rate.

Another object is to provide a grinding machine wherein a pair of independently controlled workpieces may be ground simultaneously on a single grinding wheel.

Other objects and advantages of the invention will be apparent from the following detailed description and claims appended hereto.

DESCRIPTION OF THE PREFERRED EMBODIMENT

Figure 1:
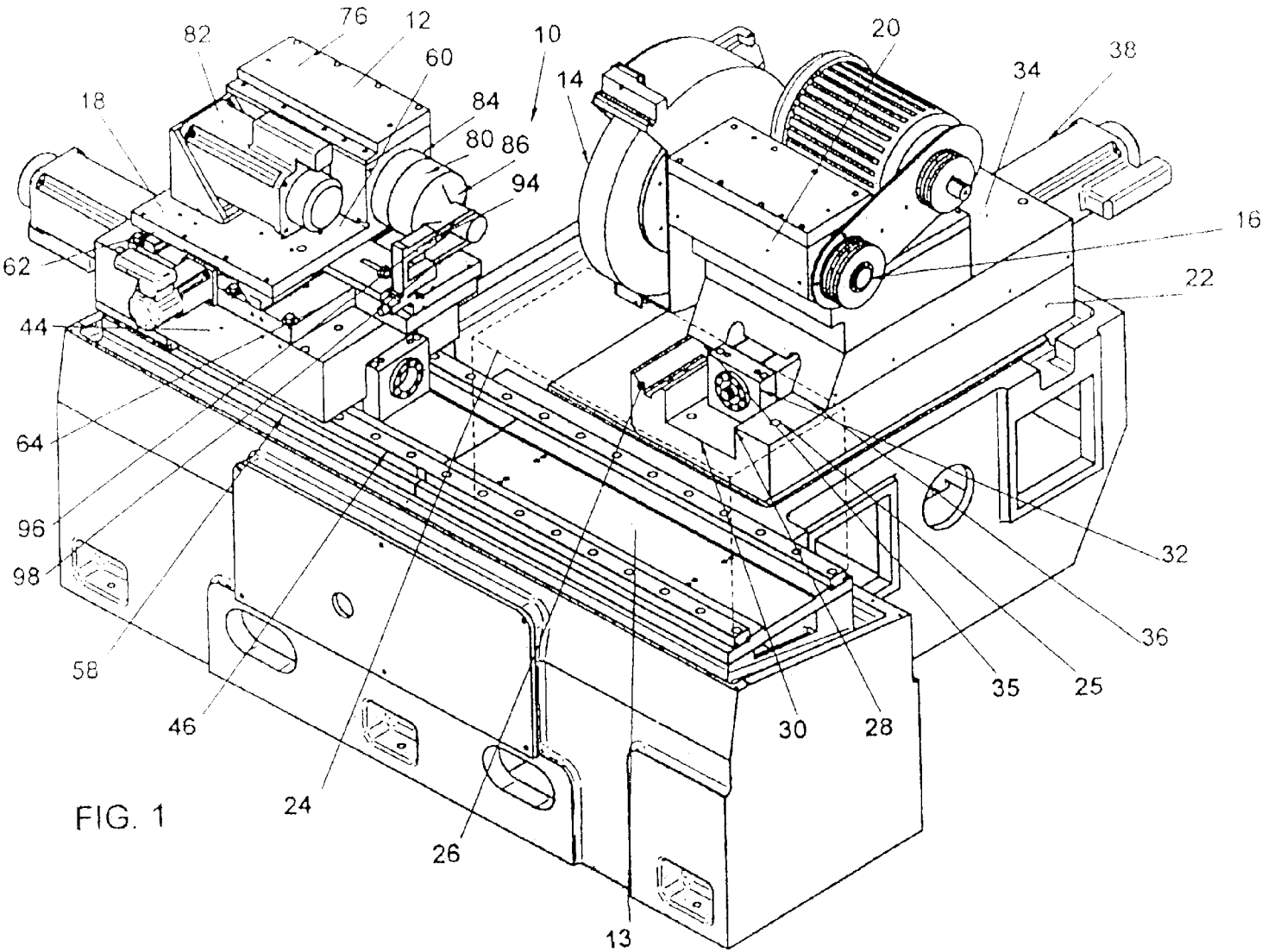
FIG. 1 is an overall isometric view of a grinding machine embodying the invention.

Referring to FIG. 1 of the drawings, there is shown a grinding machine 10 on which workpieces supported on dual workheads, 12, 13 may be ground by being brought into contact with a grinding wheel 14 carried on spindle 16. Right workhead 13, designated only by dotted lines, is a mirror image of left workhead 12, and it is to be understood that all description of the left workhead applies equally to the right one.

Workhead 12 is supported on carriage assembly 18 structured to provide linear movements in X and Y directions as required for positioning of workpieces, while wheelhead assembly 20 provides for movement only in a direction perpendicular to the wheel spindle.

Wheelhead assembly 20 has a fixed block 22 secured to horizontal base 24, with a V and flat way 25, including a V groove 26 defined adjacent one edge and a flat surface 28 defined along the other edge. A channel 30 of rectangular cross section, in which bearing blocks 32 are located, extends along the length of the block.

Wheel slide 34 is arranged for linear movement-along block 22 with movement being guided by a V-shaped projection 35 extending along the bottom of the slide on one side and conforming to V groove 26. A flat surface 36 is provided along the other side of the slide in position to come in to sliding contact with flat surface 28 defined along the other edge. A channel 30 of rectangular cross section, in which bearing blocks 32 are located, extends along the length of the block.

Wheel slide 34 is arranged for linear movement along block 22 with movement being guided by a V-shaped projection 35 extending along the bottom of the slide on one side and conforming to V-groove 26. A flat surface 36 is provided along the other side of the slide in position to come into sliding contact with flat surface 28 along the top of block 22.

Figure 2:
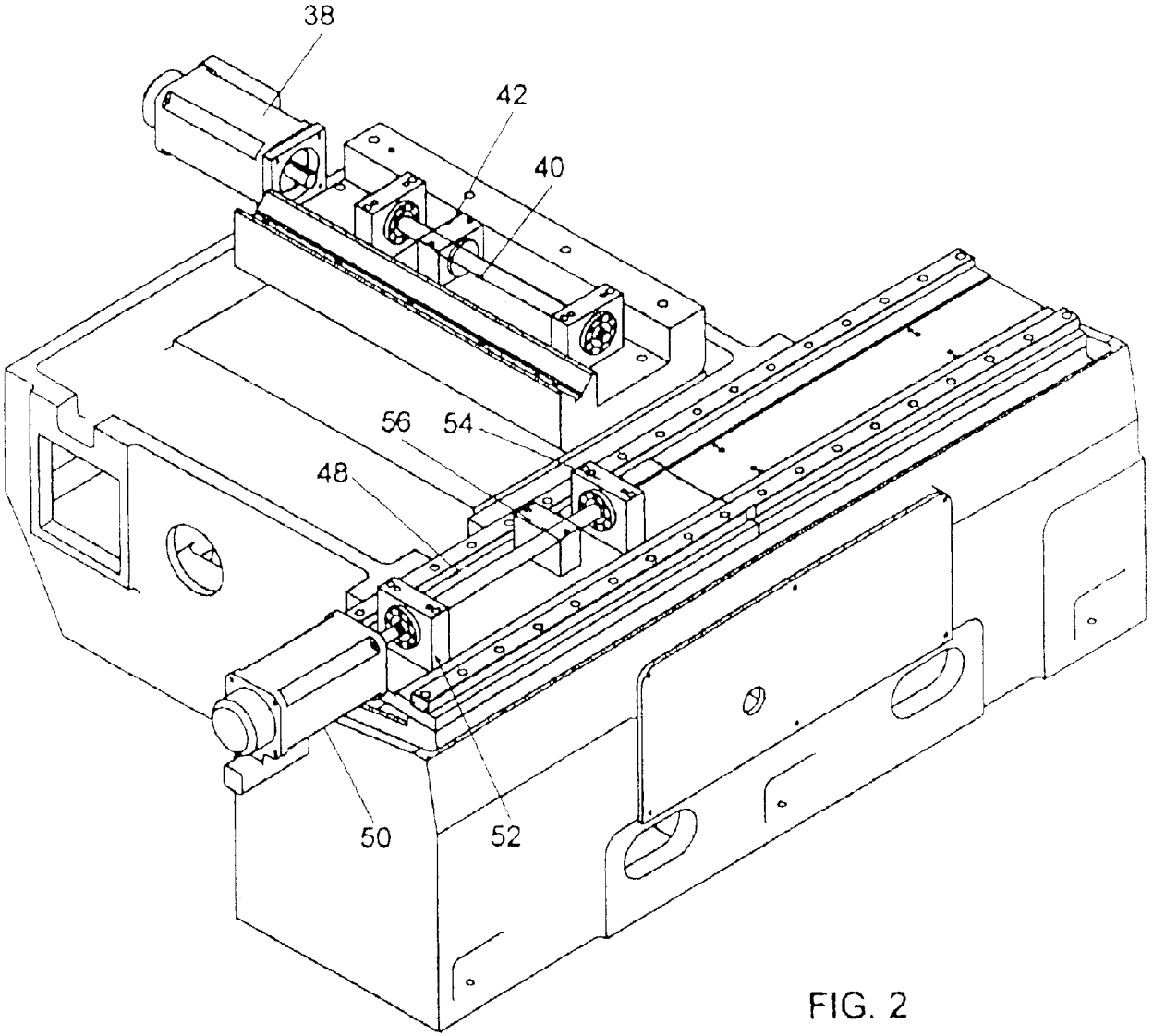
FIG. 2 is an isometric view showing underlying support structure for the movable workheads and a wheelhead of the machine of FIG. 1.

Servo motor 38, located at the outside end of wheelhead block 22, drives a ball screw 40 (FIG. 2), which propels a ball nut 42 connected to wheelslide 34, thus moving the grinding wheel inward toward the workheads and outward away from them.

In operation, movement of the wheelslide toward and away from the workheads may be controlled by the CNC system in accordance with programmed or keyboard-inputted instructions. For high-precision applications inward movement at startup of grind would be limited to bringing the wheelhead into a desired starting position and holding such position fixed while independently controlled movements of the dual workheads provide movements during grinding.

Workhead carriage assembly 18 has a workslide 44 with a bottom structure adapted to fit over linear rails 46 disposed on base 24 and aligned parallel to spindle 16 of the wheelhead. Movement of the workslide in a direction parallel to the spindle is provided by ball screw 48 (FIG. 2) driven by servo motor 50. The balls crew is mounted on bearing blocks 52, 54 fixed to the base, and ball nut 56, bolted to the slide, propels the slide upon turning of the ball screw. Bearing packs 58 include bearings which come into moving contact with sides of linear rails 46.

Figure 3:
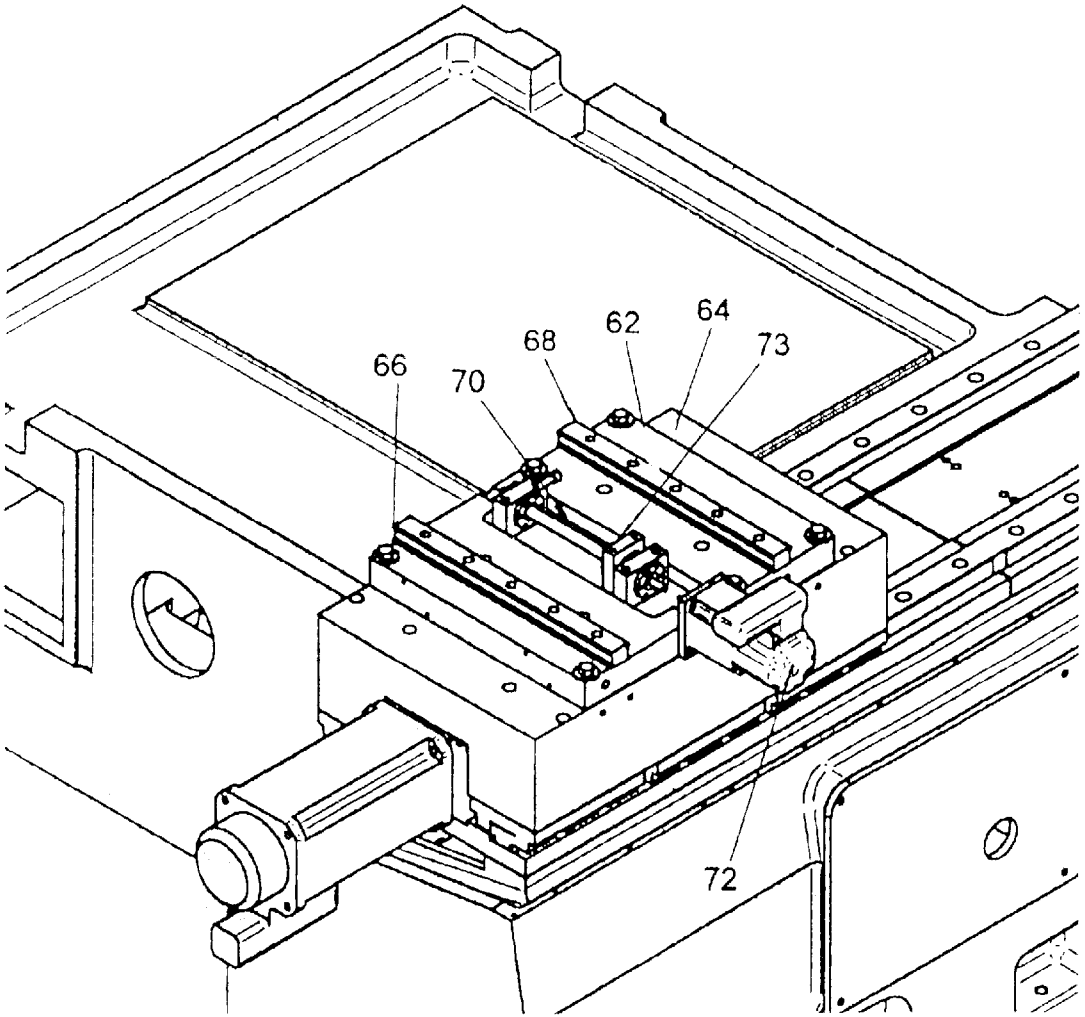
FIG. 3 is an isometric view showing movable support structure for a cross slide of the grinding machine.

Cross slide 60, which enables controlled movement perpendicular to the workslide linear rails and to the grinding wheel spindle, is located on top of workslide 44. Cross slide 60 has a base plate 62 slidably mounted on top of supporting plate 64 (FIG. 3) attached to the work slide. Linear rails 66, 68 connected to base plate 64 provide a track for movement of the cross slide. In a manner similar to structure of the workslide, movement of the cross slide is produced by a ball screw 70 driven by a servo motor 72, with a movable ball nut 73 being connected to base plate 62. Bearing packs 74 (FIG. 4) disposed along the lengths of linear rails 66, 68 to facilitate movement of the cross slide.

A spindle case 76, carrying a spindle 78 for operation of a rotating chuck 80, is connected to plate 62 with a driving motor 82 placed alongside. Chuck 80 is mounted on spindle nose 84 and includes clamping jaws 86.

Figure 4:
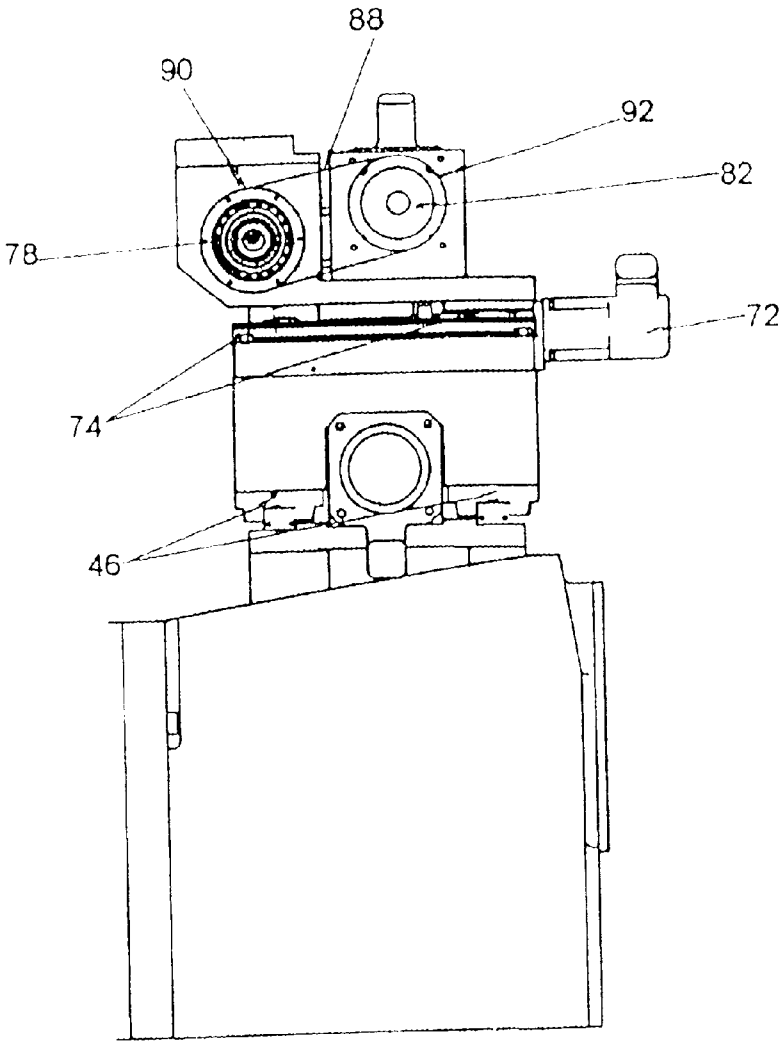
FIG. 4 is an end view of a workhead assembly taken from an outside location at a corner of the machine.

As shown in FIG. 4, chuck 80 is powered for rotation by motor 82 connected to the chuck through belt 88 which engages pulleys 90, 92. The workhead may also carry a gauge 94 in position to obtain a real-time indication of completion of programmed grinding. The gauge shown in FIG. 1 has cantilevered sensors 96, 98, one provided for outer diameter monitoring of a cylindrical workpiece and the other monitoring other parameters, as required. The sensor may provide a signal to the control system which initiates immediate shutdown.

In operation of the machine, workpieces to be ground are secured in position by jaws or other holders of the at chucks and are placed in proper alignment for coming into contact with the grinding wheel upon being moved. Movements of the workheads which support the workpieces are controlled by a CNC system which includes dual workhead controls, each one independent of the other.

Figure 5:
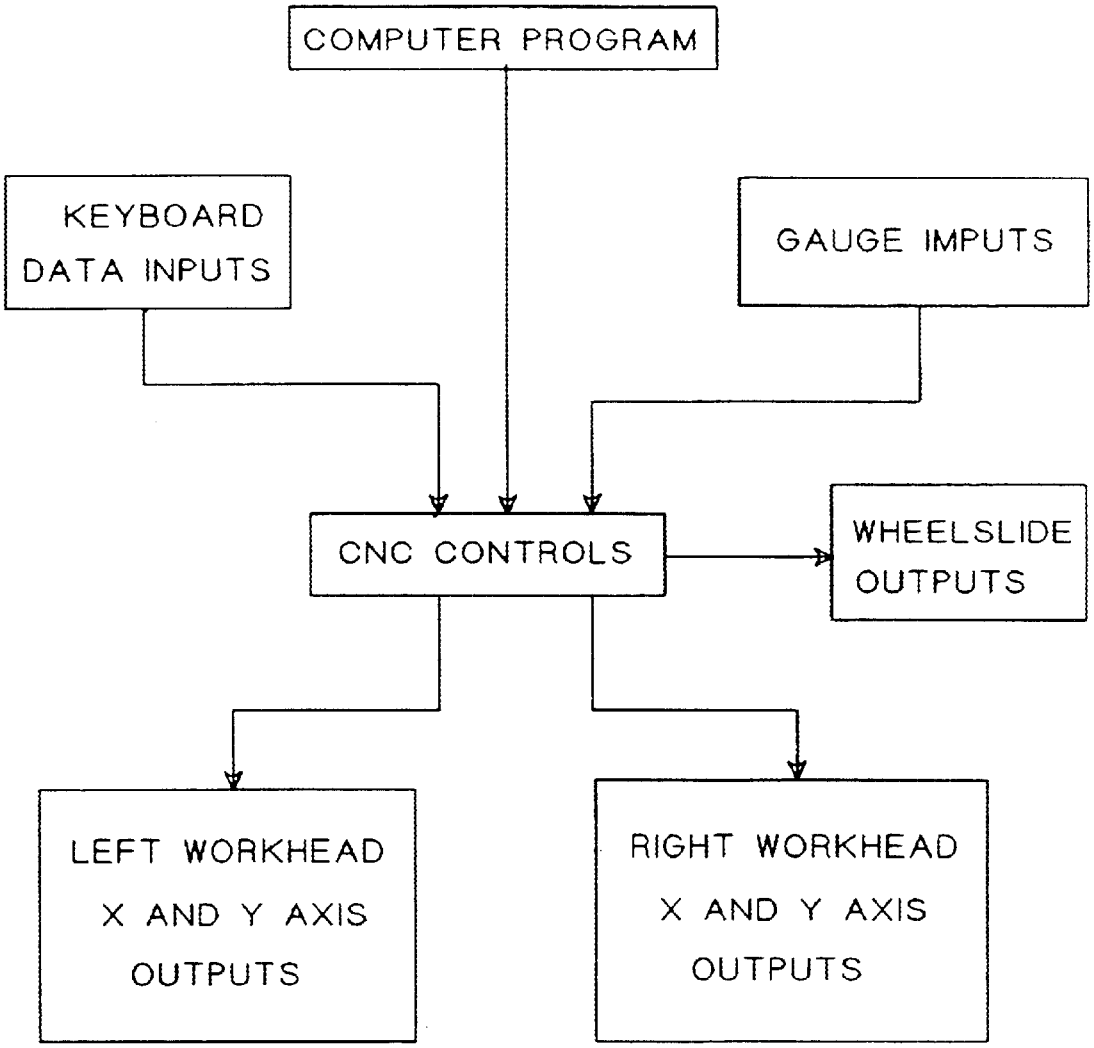
FIG. 5 is a schematic view showing operation of a control system for the machine.

FIG. 5 schematically shows a CNC control system for implementing the invention. Inputs to the system may come from prepared computer programs, keyboard-inputted modifications to the programs or gauges or other sensors monitoring the grinding process. Data processing outputs are converted to signals actuating the dual workheads, chucks and wheelhead. The wheelhead is programmed to provide movement of the grinding wheel along a single input axis to a desired location, after which movement of the wheelhead ceases, and relative movement of wheel and workpieces is obtained only by workhead movements. Inputs to each of the workheads provides signals implementing programmed movements along X and Y axis through movements of the work slide and cross slide. Movements of workpiece supporting chucks around programmed rotary axes are also implemented.

A typical sequence of events in operation of the machine is illustrated as follows:

1. Part is loaded into work holding device in both workheads.
2. Cycle start is actuated.
3. Grinding wheel axis (main process) initiates command for workheads to run their respective programs. Left workhead and its related axis is designated as process 1 and the right workhead (and related axis) is designated as process 2.
4. Grinding Wheel axis moves into grind position, which is designated by its program.
5. Left and right workheads position themselves into their respective grind positions.
6. Left and right workheads begin running the axis cross feeds at the programmed feed rate to the desired position to achieve final part size:

a. should either process (1 or 2) achieve size first, that respective workhead is retracted from the grinding wheel and commanded to return to its "home" or programmed load position b. the remaining process continues program execution until final size is reached, irrespective of the other process c. when process in b. achieves size, the workhead retracts from grinding wheel and returns to "home" or its commanded position.

7. Processes 1 and 2 signal main process that they have completed their tasks.

8. Main process completes its program execution.

9. Repeat steps 1–8, as required.

The dual workhead chucker grinding machine as described above for external grinding, may be adapted, by modifications made at the manufacturing level to provide for simultaneous internal grinding of bores in a pair of workpieces.

In order to obtain this result the grinding wheel, spindle case and driving motor would be removed from the wheelhead assembly and replaced with a pair of grinding wheels, a double-shaft motor and driving belts carried on supporting structure.

Figure 6:
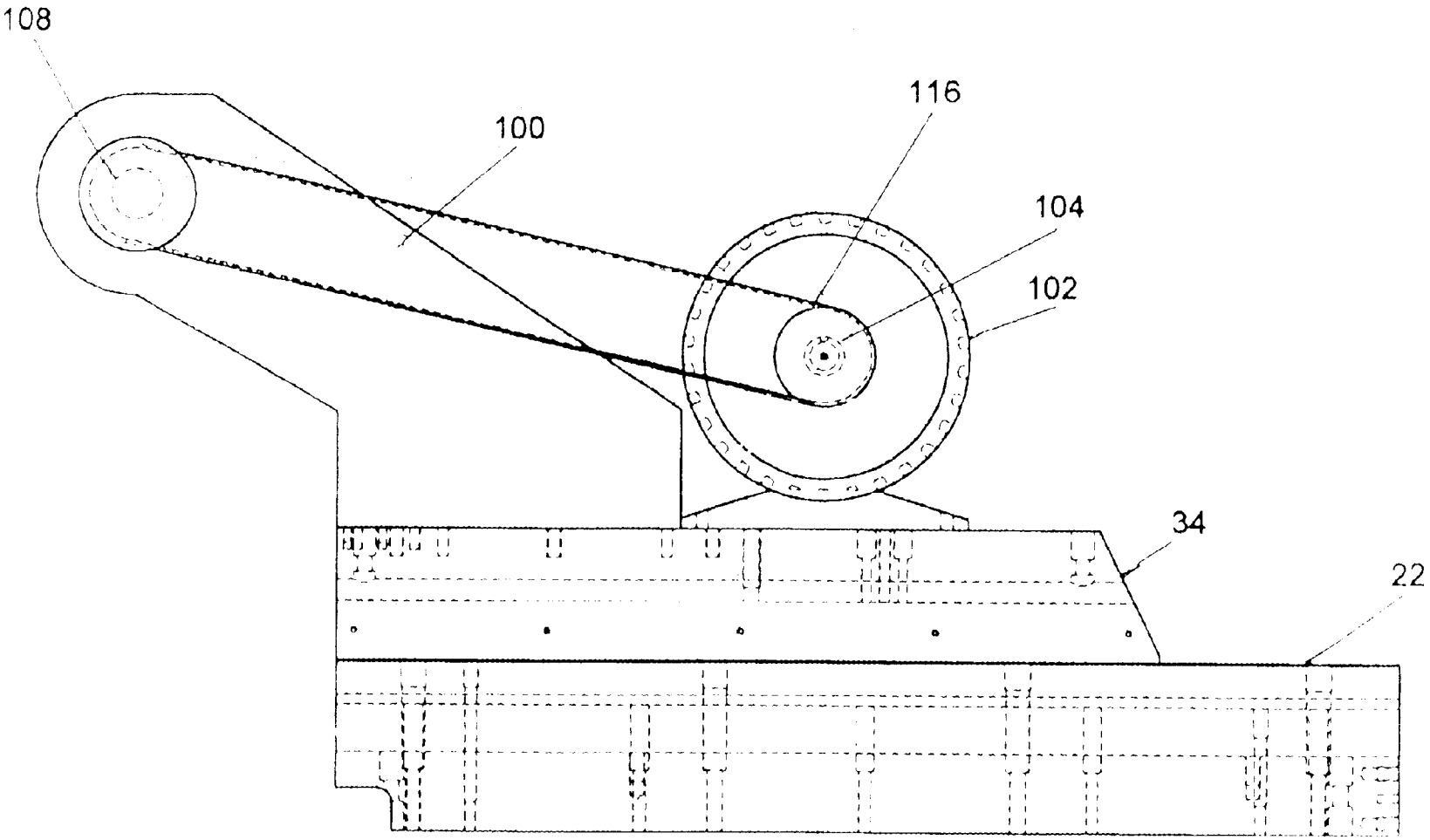
FIG. 6 is a schematic side view of an embodiment wherein dual grinding wheels for internal grinding are provided.
Figure 7:
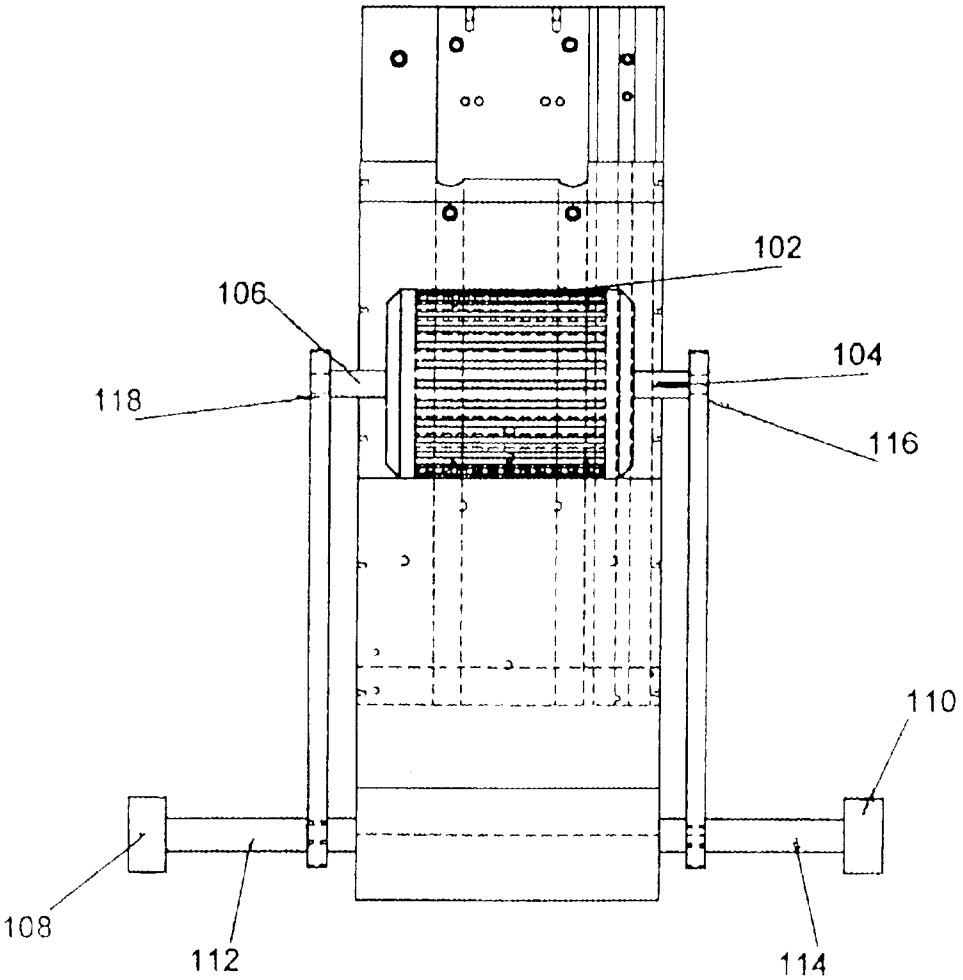
FIG. 7 is a schematic top view of the machine of FIG. 6.

As shown schematically in FIG. 6, fixed block 22 and slide 34 of the wheelhead are retained. A dual internal grinding assembly 100 is secured to the moving slide. Assembly 100 includes a double-shaft motor 102 aligned as shown in FIG. 7, with the shafts 104, 106 driving a pair of internal grinding wheels 108, 110 supported on arbors 112, 114 and. extending in position for workpieces supported by the workheads to be brought into grinding contact. The wheels are driven by belts connected to pulleys 116, 118 on shafts 104, 106.

In operation, movement of the dual workheads is controlled by separate and independent controls using the CNC control system as for external grinding, as described above.

Although the invention is illustrated by a specific described embodiment including numerous details, it is not to be understood as so limited, but is limited only as indicated by the appended claims.

What is claimed is:

1. A grinding machine comprising:

a base;

a wheel spindle;

a wheelhead carried by said base including an abrasive wheel mounted on said spindle and providing a plurality of grinding surface locations;

a pair of workheads each comprising a lateral workslide movable along a first path parallel to said spindle, a cross slide movable along a second path perpendicular to said spindle and a workpiece grasping device in position to be moved so as to support a said workpiece against said wheel at a grinding location;

a separate motion-imparting device coupled to each said workslide and to each said cross slide; and a CNC control system including controls coupled to each said workhead separate and independent of controls for the other said workhead, whereby precise grinding positioning of each said workpiece independent of positioning of the other said workpiece may be obtained.

2. The grinding machine as defined in claim 1 wherein said wheelhead is movable along a path perpendicular to said spindle.

3. The grinding machine as defined in claim 1, further comprising in each said workhead a laterally extending support member carried by said base and having a slideable surface and a mating slidable surface carried by said workslide in position to be slid along said support member.

4. The grinding machine defined in claim 3 wherein said laterally extending support member includes a pair of linear rails defined in an upper surface thereof.

5. The grinding machine as defined in claim 3 wherein said laterally extending support member includes a V and flat surface configuration.

6. The grinding machine as defined in claim 3 wherein said motion-imparting devices comprise a ball screw, bearing blocks or housings connected to said base and receiving said ball screw, a ball nut connected to said workslide and a motor propelling said ball screw.

7. The grinding machine as defined in claim 6 wherein said motor comprises a servo motor.

8. The grinding machine as defined in claim 1 wherein said workpiece grasping device comprises a chuck having a plurality of movable jaws.

9. The grinding device as defined in claim 8 wherein said chuck is coupled to rotary driving means.

10. The grinding machine as defined in claim 9 wherein said chuck is rotatable around a selected one of a plurality of axes.

11. The grinding machine as defined in claim 3 further comprising a gauge having at least one sensor adapted to provide a shutoff signal upon attainment of a predetermined workhead dimension.

12. A grinding machine support structure comprising:

a base;

a wheelhead carried by said base including a spindle and an abrasive wheel rotatably mounted on said spindle;

a pair of workheads each comprising a laterally moveable workslide adapted for sliding along a first path parallel to said spindle, a cross slide adapted for movement along a second path perpendicular to said spindle, a clamping device located for grasping a workpiece in position to be brought into contact with said wheel; and means for imparting linear motion to said workslide and said cross slide.

13. The support structure as defined in claim 12 wherein said means for imparting linear motion comprises a ball screw carried by bearing blocks connected to a fixed base, a ball nut engaging said ball screw and connected to a movable upper member and a servo motor driving said ball nut.

14. The support structure as defined in claim 13 wherein facing surfaces of said workslide and a support surface on which the workslide is mounted have linear rails or a V and flat shape on a said supporting surface and a mating upper surface on a sliding member that rides on the support surface.

15. A grinding machine comprising a base;

a wheelhead carried by said base and including a pair of grinding wheels adapted for grinding inside diameters of selected workpieces, said grinding wheels carried by a support assembly mounted on a wheelhead slide and propelled for grinding by a double shaft motor having a rotating shaft at each end thereof and connected to said wheels by belts and pulleys engaging the belts;

a pair of workheads each comprising a lateral workslide movable along a first path parallel to a spindle axis of a said grinding wheel and a cross slide movable along a second path perpendicular to a said spindle axis and a workpiece grasping device in position to be moved so as to support a said workpiece against said wheel at a grinding location;

a separate motion-imparting device coupled to each said workslide and to each said cross slide; and a CNC control system including controls coupled to each said workhead separate and independent of controls for the other said workhead, whereby precise grinding positioning of each said workpiece independent of positioning of the other said workpiece may be obtained.

* * * * *